US006647203B1

(12) United States Patent
Helt et al.

(10) Patent No.: US 6,647,203 B1
(45) Date of Patent: Nov. 11, 2003

(54) AIR HANDLER POWER DISTRIBUTION SYSTEM

(75) Inventors: Robert W. Helt, Tyler, TX (US); Stephen A. Guy, deceased, late of Tyler, TX (US), by Barbara A. Guy, executrix

(73) Assignee: American Standard Inc., Piscataway, NJ (US)

( * ) Notice: Subject to any disclaimer, the term of this patent is extended or adjusted under 35 U.S.C. 154(b) by 0 days.

(21) Appl. No.: 09/369,827

(22) Filed: Aug. 6, 1999

(51) Int. Cl.[7] ..... F24H 3/00
(52) U.S. Cl. ..... 392/360; 219/541; 261/142
(58) Field of Search ..... 392/360, 365–369, 392/379–385, 390; 219/541; 261/142, DIG. 65

(56) References Cited

U.S. PATENT DOCUMENTS 2,628,083 A * 2/1953 Rense ..... 392/360
3,260,442 A 7/1966 Laing
4,737,616 A * 4/1988 Wen-Ying ..... 392/365
5,133,042 A * 7/1992 Pelonis ..... 392/365
5,259,062 A * 11/1993 Pelonis ..... 392/365

FOREIGN PATENT DOCUMENTS

DE 2757011 * 7/1979 ..... 392/379
FR 2578961 * 9/1986

* cited by examiner

*Primary Examiner*—John A. Jeffery
(74) *Attorney, Agent, or Firm*—William J. Beres; William O'Driscoll; Peter D. Ferguson

(57) ABSTRACT

A power distribution system for an air handler is reconfigureable by way of selectively connectable plug-in connectors. The air handler includes a blower associated with a first plug-in connector that is selectively connectable to a second plug-in connector of a heater and a third plug-in connector of an electric air cleaner. If the air handler includes a heater but not the electric air cleaner, then the blower connector plugs into the heater connector. If the air handler includes an electric air cleaner but not a heater, then the blower plugs into the connector of the air cleaner. And if the air handler includes both a heater and an electric air cleaner, then a three-way electrical connector couples the blower to both the heater and the air cleaner.

15 Claims, 5 Drawing Sheets

AIR HANDLER POWER DISTRIBUTION SYSTEM

BACKGROUND OF THE INVENTION

1. Field of the Invention

The subject invention generally pertains to an air handler and more specifically to an air handler connected to a reconfigureable electrical distribution system.

2. Description of Related Art

Air handlers typically condition the air of a comfort zone, such as a room or area within a building, and can assume a variety of configurations. Many air handlers include a fan or blower to move the air across a heat exchanger, such as an evaporator or condenser of a heat pump or some other refrigeration system. They can also include a variety of other components or accessories, such as an electrostatic air cleaner and/or supplemental electric heaters. Unfortunately, the variety of configurations can create a problem for an electrician installing the equipment.

For example, when an electrostatic air cleaner is to be added to an air handler having an electric heater, a 115 or 230-volt outlet may not be available for the air cleaner. Since installing such an outlet adds to the time and cost of the air cleaner's installation, an electrician may consider wiring the air cleaner in parallel with the 115 or 230-volt electric heater. However, such an approach often violates national and local electrical codes, as the current draw of a heater is usually much higher than that of an air cleaner. Consequently, an air cleaner's lighter gage wiring may be inadequately protected against current overload (e.g., a short circuit) when it is connected in parallel with a heater's heavier gage wiring. This is especially true when the heavier wiring is protected by a circuit breaker that is appropriate for the heavier wiring but oversized for the lighter wiring.

SUMMARY OF THE INVENTION

To facilitate the installation of air handlers of various configurations, it is an object of the invention to provide a power distribution system that is reconfigureable by way of selectively connectable plug-in connectors.

Another object of the invention is to safely connect lighter gage wiring of an air handler accessory in parallel with an electric heater having heavier gage wiring.

Another object is to provide a three-way electrical connector that reconfigures an air handler to accept various accessories.

Yet another object is to provide a reconfigureable plug-in connector that conveys both control voltage and higher power voltage.

A further object of the invention is to effectively protect both lighter and heavier gage wiring with a common circuit breaker.

A still further object is to avoid the time and cost of installing an additional electrical outlet dedicated to power an accessory of an air handler.

These and other objects of the invention are provided by an air handler that includes a blower associated with a first plug-in connector that is selectively connectable to a second plug-in connector of a heater and a third plug-in connector of an electric accessory to selectively reconfigure the air handler.

BRIEF DESCRIPTIONS OF THE DRAWINGS

DESCRIPTION OF THE PREFERRED EMBODIMENT

Figure 1:
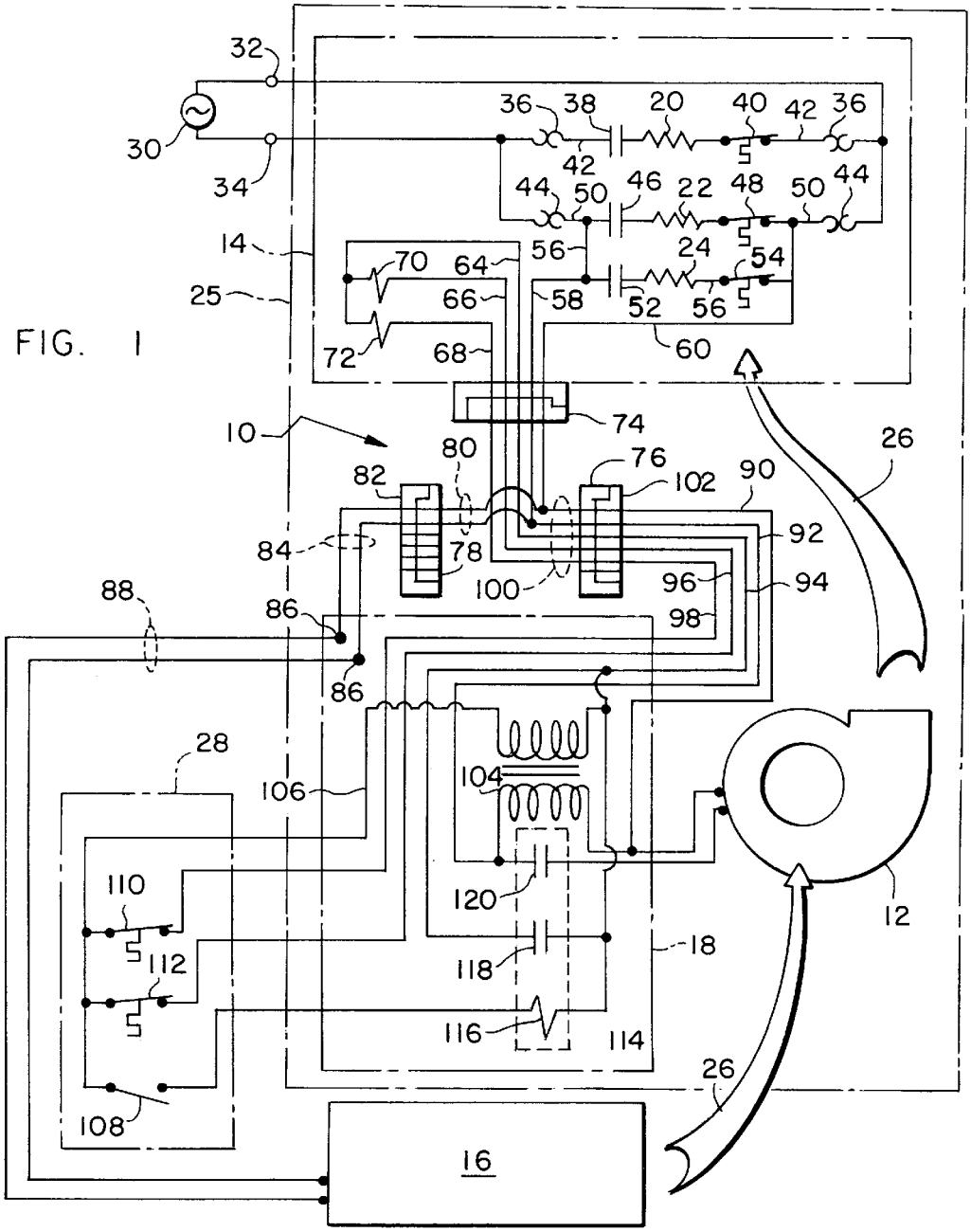
FIG. 1 is a wiring schematic of an embodiment of the invention showing an air handler in one configuration.

An air handler, schematically illustrated in FIG. 1, includes a three-way connector 10 that electrically interconnects a blower 12, a heater assembly 14, an electric air cleaner 16, and an electrical panel 18. Blower 12 draws return air from a comfort zone and through cleaner 16 that electrostatically removes dust and other airborne particles. Blower 12 discharges the air across one or more heaters, such as heaters 20, 22 and 24, to provide heated supply air to the comfort zone when needed. Arrows 26 denote the general direction of airflow. Typically the blower 12 and the heater assembly 14 share a common housing 25. The air cleaner 16 is preferably connected upstream of the housing 25 so that air flows through the air cleaner 16 into the blower 12, and across the heaters 20, 22, 24. In some embodiments, the air handler also includes a refrigeration system, such as a heat pump that also conditions the temperature and/or humidity of the comfort zone. In such embodiments, the heat pump provides the primary cooling or heating, while heaters 20, 22 and 24 supplement heating as needed. In response to sensing the temperature and/or humidity of the comfort zone, a conventional thermostat 28 controls the operation of heater assembly 14 and blower 12, and may further control the operation of the heat pump, if present.

In the embodiment of FIG. 1, an electrical supply 30 (e.g., power voltage of 230 VAC) is applied across supply leads 32 and 34 to power the air handler. Two current interrupters 36 (e.g., a 30-amp circuit breaker or fuse), a set of normally open relay contacts 38 and a normally closed temperature limit switch 40 are connected electrically in series with heater 20. This allows electrical supply 30 to energize heater 20 when contacts 38 and limit switch 40 are closed. Under normal operation, temperature limit switch 40 remains closed and only opens upon sensing an abnormally high temperature brought on by, for example, insufficient airflow across heater 20. A relatively heavy wire 42 (e.g., 12-gage wire) provides the series connection of the heater-related components. Similarly, two more current interrupters 44 (e.g., 60-amp circuit breaker or fuse), a set of normally open relay contacts 46 and a normally closed temperature limit switch 48 (similar or identical to switch 40) are connected electrically in series with heater 22. Supply 30 energizes heater 22 when contacts 46 and limit switch 48 are closed. Interconnecting wire 50 is similar to that of wire 42. A set of relay contacts 52 and a temperature limit switch 54 (similar or identical to switch 40) couple heater 24 electrically in parallel with heater 22 and in series with breakers 44. Thus, breakers 36 protect wiring 42, while breakers 44 protect wiring 50 and also protect interconnecting 12-gage wire 56 associated with heater 24. Electrical power leads 58 and 60 are wired to a plug-in connector 62 (e.g., a socket 19-09-2061 w/02-09-2101 by Molex of Lisle, Ill.). An additional three leads 64, 66 and 68 connect socket 62 to a 24-volt (control voltage) relay coil 70 associated with contacts 38 and 46, and a similar relay coil 72 associated with contacts 52.

Three-way connector 10, comprising plug-in connectors 74, 76 and 78, plugs into socket 62 by way of connector 74 (e.g., a Molex plug 19-09-1061 w/02-09-1102). Connectors 62 and 74 connect power voltage leads 58 and 60 to air cleaner 16 by way of wires 80, a connector 78 (e.g., a Molex plug 19-09-1061 w/02-09-1102), a mating plug-in connector 82 (e.g., a Molex socket 19-09-2061 w/02-09-2101), wires 84, wire nuts 86, and an air cleaner power cord 88. Connectors 62 and 74 also connect leads 60, 58, 64, 66 and 68 to wires 90, 92, 94, 96 and 98 respectively by way of wires 100, a plug-in connector 76 (e.g., a Molex socket 19-09-2061 w/02-09-2101), and a mating plug-in connector 102 (e.g., a Molex plug 19-09-1061 w/02-09-1102). In this embodiment, wires 90, 92, 94, 96 and 98 feed into panel 18.

Within panel 18, wires 90 and 92 apply power voltage to the primary windings of a transformer 104 to provide 24 VAC control voltage across wire 94 and a wire 106. Wire 106 conveys the control voltage onto thermostat 28. Since there are a wide variety of thermostats know to those skilled in the art, thermostat 28 is schematically illustrated to include a blower switch 108 and two temperature switches 110 and 112, all of which receive control voltage from wire 106. Switches 110 and 112 both close in response to the temperature of the comfort zone dropping to a set point, but each at a slightly different set point. Blower switch 108 closes in response to a demand for airflow, e.g., whenever switch 110 or 112 calls for heat. Blower switch 108 closing energizes a coil 114 of a blower relay 116 to close its contacts 118 and 120. Contacts 120 energize blower 112, while contacts 118 enable switches 110 and 112 to energize their respective coils 72 and 70. Switch 110 closing energizes coil 72 through leads 64 and 68 to actuate contacts 52, which turns on heater 24. Switch 112 closing energizes coil 70 through leads 64 and 66 to actuate contacts 38 and 46. Contacts 38 and 46 turn on heaters 20 and 22 respectively.

In many cases, wiring a low wattage component with light gage wire in parallel with a higher wattage component having heavier gage wire is considered poor wiring practice and often violates electrical codes. However, a unique opportunity presents itself with an air handler having several high-wattage heaters and a low wattage air cleaner connected as shown in FIG. 1. For air handlers, some electrical codes restrict the maximum allowable current draw of heaters to about 48 amps when the heater wiring is protected by just one pair of circuit breakers. For heat requirements above 48 amps, multiple heaters are wired in parallel to each other to create several parallel circuits each wired with, for example, 12-gage wiring (to conduct up to 48 amps). And each parallel circuit can be protected by a pair of standard-sized 30-amp or 60-amp breakers, depending on the size of the heater or heaters. However, 18-gage wiring can also readily trip a 60-amp breaker. Thus, lighter 18-gage wire can safely connect an appropriately sized, relatively low wattage air cleaner in parallel with a heater, provided the air cleaner is wired in series with one pair of breakers that protects the heater's heavier gage wiring. For example, one pair of breakers can protect both the 12-gage wire leading to a heater and a lighter 18-gage wire feeding an air cleaner.

For the exemplary embodiment of FIG. 1, air cleaner power cord 88 is 16-gage wiring that electrically connects air cleaner 16 in parallel with heater 24 and in series with breakers 44. Heaters 20, 22 and 24 each draw about twenty amps, and breaker 44 is rated at sixty amps. Thus, breaker 44 protects the 12-gage wiring 50 and 56 of respective heaters 22 and 24 as well protects the 16-gage wiring of power cord 88.

Figure 2:
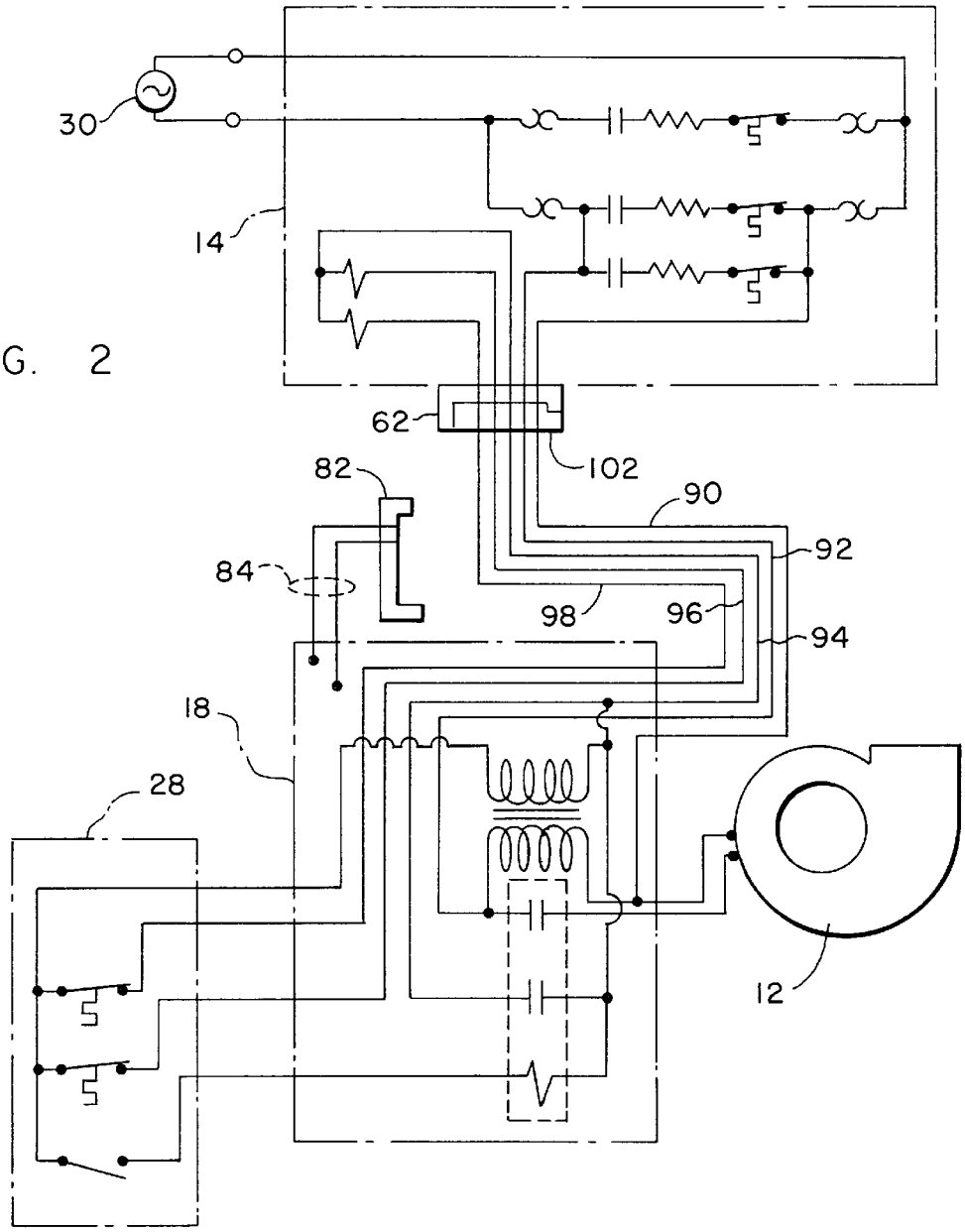
FIG. 2 is a wiring schematic of an embodiment of the invention showing an air handler in a second configuration.

The air handler of FIG. 1 can also be reconfigured as shown in FIG. 2. When air cleaner 16 is omitted, blower connector 102 plugs directly into heater socket 62, and the three-way connector 10 and the air cleaner power cord 88 are not required. Socket 82 and wires 84 can be removed or left unused as shown. The operation of blower 12, heater assembly 14 and thermostat 88 remains basically the same as that of the configuration of FIG. 1.

Figure 3:
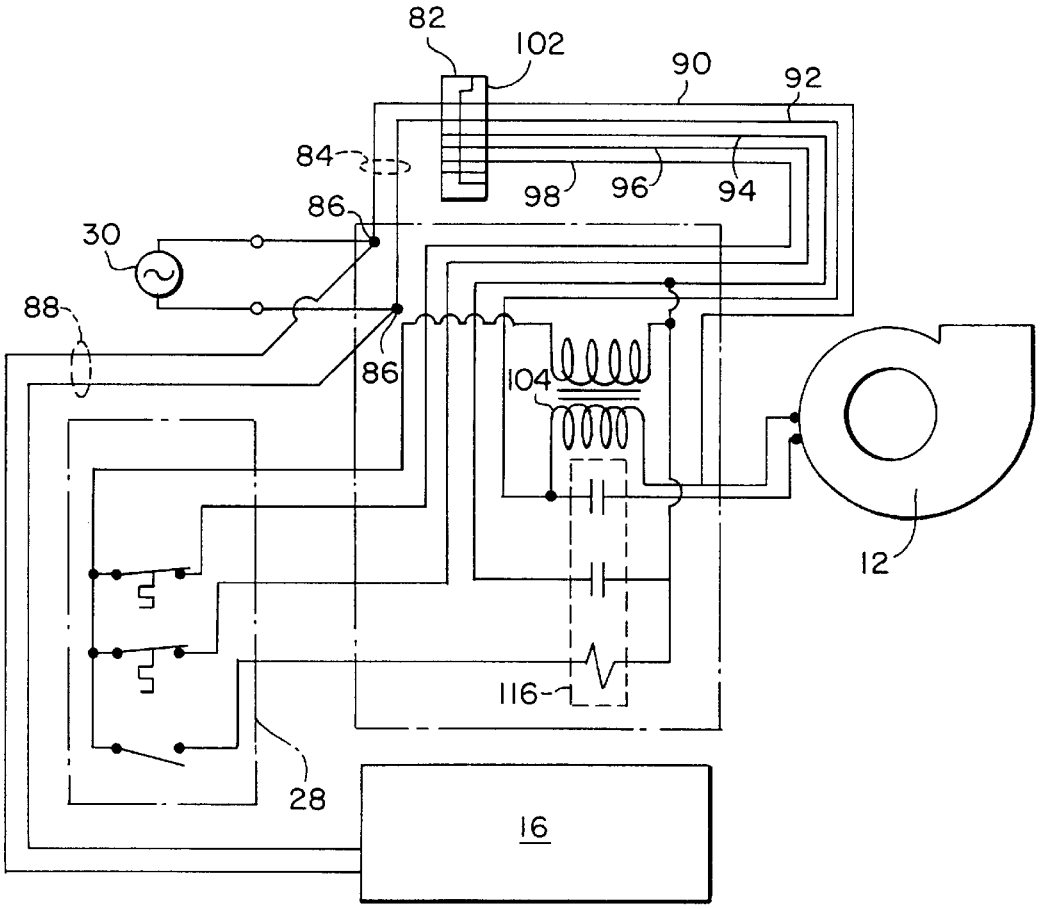
FIG. 3 is a wiring schematic of an embodiment of the invention showing an air handler in a third configuration.

In another configuration, shown in FIG. 3, the air handler includes air cleaner 16 but does not include heater assembly 14. In this example, blower connector 102 plugs directly into socket 82, and electrical supply 30 delivers power voltage directly to the air cleaner power cord 88 and wires 84 at wire nuts 86. Wires 84 deliver the power voltage to wires 90 and 92 to energize blower 12 and transformer 104.

Figure 4:
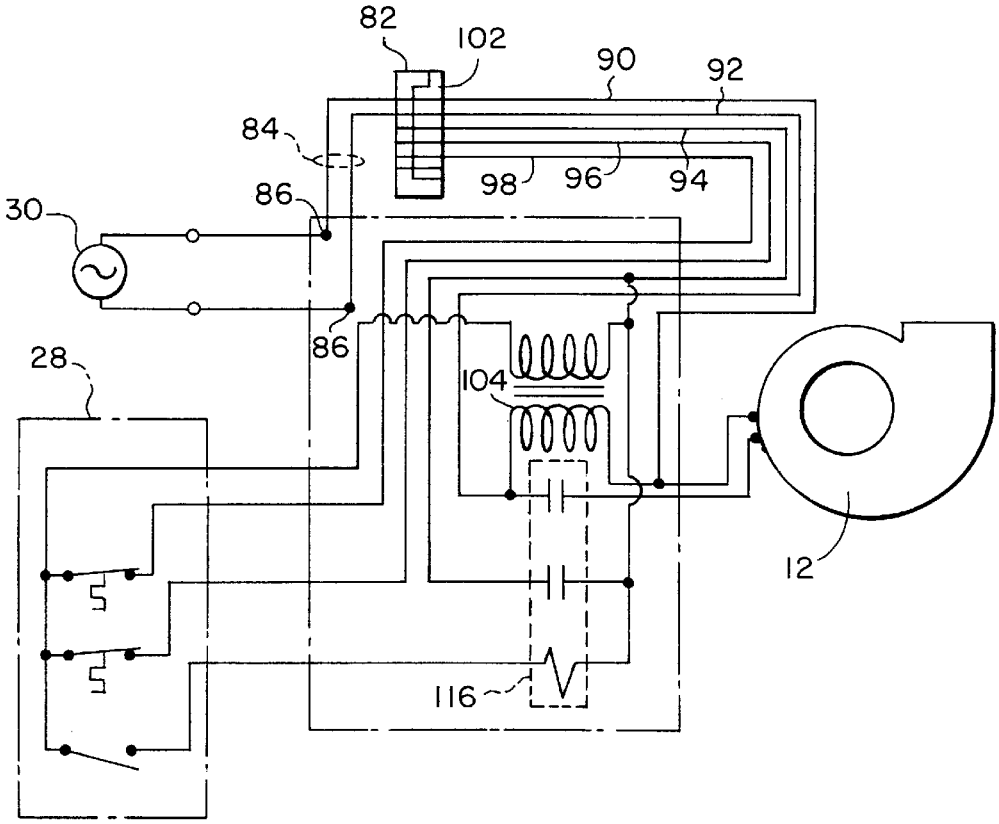
FIG. 4 is a wiring schematic of an embodiment of the invention showing an air handler in a fourth configuration.

In yet another configuration, shown in FIG. 4, the air handler has neither heater assembly 14 nor air cleaner 16. Here, blower connector 102 plugs directly into socket 82, and electrical supply 30 delivers power voltage to blower 12 and transformer 104 by way of wires 84, connectors 82 and 102, and wires 90 and 92.

Figure 5:
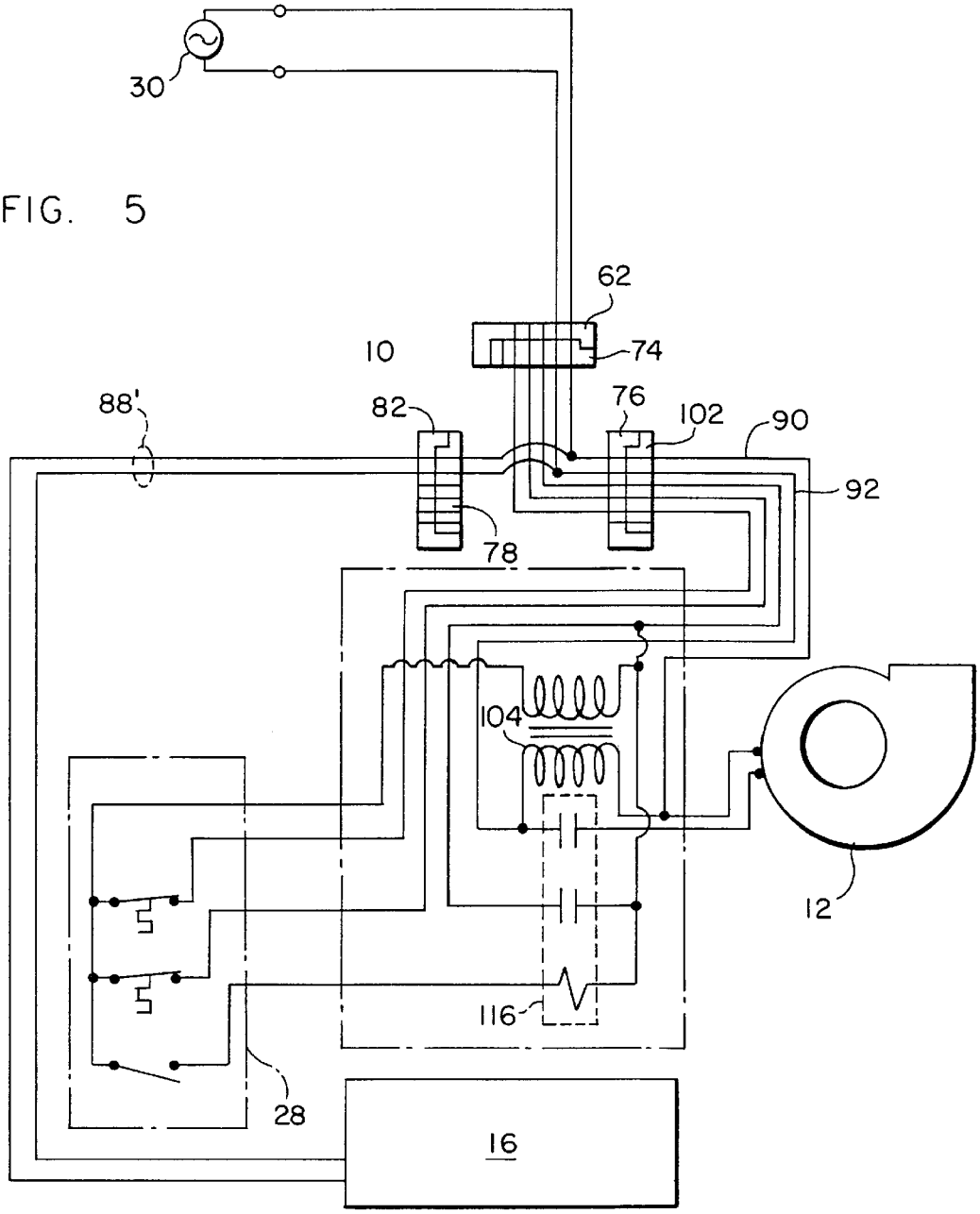
FIG. 5 is a wiring schematic of an embodiment of the invention showing an air handler in a fifth configuration.

The embodiment of FIG. 5 is similar to that of FIG. 3; however, wire nuts 86 are eliminated by combining wires 84 and 88 (FIG. 3) to create a continuous power cord 88' that directly couples air cleaner 16 to socket 82. To power air cleaner 16 and blower 12, power supply 30 is connected to socket 62, which, in turn, is coupled to air cleaner socket 82 and blower plug 102 by way of three-way connector 10.

Although the invention is described with respect to a preferred embodiment, various modifications thereto will be apparent to those skilled in the art. For example, plugs 74, 78 and 102 could be sockets when sockets 62, 76 and 82 are plugs. Therefore, the scope of the invention is to be determined by reference to the claims, which follow.

We claim:

1. An air handler, comprising:

an electric heater;

an electric air cleaner;

a blower;

a first plug-in connector electrically coupled to said electric heater;

a second plug-in connector electrically coupled to said electric air cleaner;

a third plug-in connector electrically coupled to said blower, said third plug-in connector being selectively coupleable to said first plug-in connector and said second plug-in connector, thereby rendering said air handler selectively reconfigureable; and a three-way connector that includes a fourth plug-in connector, a fifth plug-in connector and a sixth plug-in connector, wherein said fourth plug-in connector is coupleable to said first plug-in connector, said fifth plug-in connector is coupleable to said second plug-in connector, and said third plug-in connector is selectively coupleable to said first plug-in connector, said second plug-in connector and said sixth plug-in connector.

2. The air handler of claim 1, wherein at least one of said fourth plug-in connector, said fifth plug-in connector and said fifth plug-in connector is a plug, and at least one of said fourth plug-in connector, said fifth plug-in connector and said fifth plug-in connector is a socket.

3. The air handler of claim 1, wherein of said electric heater, said electric air cleaner, and said blower, at least one is powered by a primary current and at least one is controlled by a control current, wherein said primary current is supplied at a substantially higher voltage than that of said control current, and wherein said three-way plug-in connector is connected to convey both said primary current and said control current.

4. The air handler of claim 1, further comprising a pair of current interrupters connected electrically in series with said electric heater and electrically in series with said electric air cleaner, wherein said electric heater and said electric air cleaner are connected electrically in parallel with each other.

5. An air handler, comprising:

an electric heater;

an electric air cleaner;

a blower;

a first plug-in connector electrically coupled to said electric heater;

a second plug-in connector electrically coupled to said electric air cleaner;

a third plug-in connector electrically coupled to said blower; and a three-way connector that includes a fourth plug-in connector, a fifth plug-in connector and a sixth plug-in connector, wherein said fourth plug-in connector is coupleable to said first plug-in connector, said fifth plug-in connector is coupleable to said second plug-in connector, and said third plug-in connector is selectively coupleable to said first plug-in connector, said second plug-in connector and said sixth plug-in connector, thereby rendering said air handler selectively reconfigureable.

6. The air handler of claim 5, wherein at least one of said fourth plug-in connector, said fifth plug-in connector and said fifth plug-in connector is a plug, and at least one of said fourth plug-in connector, said fifth plug-in connector and said fifth plug-in connector is a socket.

7. The air handler of claim 5, wherein of said electric heater, said electric air cleaner, and said blower, at least one is powered by a primary current and at least one is controlled by a control current, wherein said primary current is supplied at a substantially higher voltage than that of said control current, and wherein said three-way plug-in connector is connected to convey both said primary current and said control current.

8. The air handler of claim 5, further comprising a pair of current interrupters connected electrically in series with said electric heater and electrically in series with said electric air cleaner, wherein said electric heater and said electric air cleaner are connected electrically in parallel with each other.

9. An air handler for conditioning an airflow, comprising:

a first electric heater of a first wattage;

a first pair of current interrupters;

a first plurality of wires of a first gage connecting said first electric heater electrically in series with said first pair of current interrupters;

a second electric heater;

a second pair of current interrupters connected electrically in series with said second electric heater; said second electric heater and said second pair of current interrupters being connected electrically in parallel with said first electric heater and said first pair of current interrupters;

an electric air cleaner that with respect to said airflow is disposed upstream of said first electric heater and said second electric heater, said electric air cleaner being of a second wattage that is less than said first wattage; and a second plurality of wires of a second gage connecting said electric air cleaner electrically in parallel with said first electric heater and electrically in series with said first pair of current interrupters, said second gage being greater than said first gage, whereby said second plurality of wires has a lower current carrying capacity than that of said first plurality of wires, yet both said first plurality of wires and said second plurality of wires are protected by said first pair of current interrupters.

10. The air handler of claim 9, wherein said blower is connected electrically in parallel with said first electric heater and said electric air cleaner.

11. The air handler of claim 10, further comprising a first plug-in connector electrically coupled to said electric heater;

a second plug-in connector electrically coupled to said electric air cleaner;

a third plug-in connector electrically coupled to said blower; and a three-way connector that includes a fourth plug-in connector coupled to said first plug-in connector, a fifth plug-in connector coupled to said second plug-in connector, and a sixth plug-in connector coupled to said third plug-in connector.

12. The air handler of claim 11, wherein at least one of said fourth plug-in connector, said fifth plug-in connector and said fifth plug-in connector is a plug, and at least one of said fourth plug-in connector, said fifth plug-in connector and said fifth plug-in connector is a socket.

13. The air handler of claim 11, wherein of said electric heater, said electric air cleaner, and said blower, at least one is powered by a primary current and at least one is controlled by a control current, wherein said primary current is supplied at a substantially higher voltage than that of said control current, and wherein said three-way plug-in connector is connected to convey both said primary current and said control current.

14. A method of reconfiguring an air handler that includes a blower plug-in connector and at least one of a heater plug-in connector and an accessory plug-in connector, comprising: attaching said blower plug-in connector directly to said accessory plug-in connector if said heater plug-in connector is absent; and attaching said blower plug-in connector directly to said heater plug-in connector if said accessory plug-in connector is absent.

15. The method of claim 14, further comprising:

attaching said blower plug-in connector directly to a three-way connector, if both said heater plug-in connector and said accessory plug-in connector are present;

attaching said heater plug-in connector to said three-way connector; and attaching said accessory plug-in connector to said three-way connector.

* * * * *

UNITED STATES PATENT AND TRADEMARK OFFICE

CERTIFICATE OF CORRECTION

PATENT NO. : 6,647,203 B1 
DATED : November 11, 2003
INVENTOR(S) : Robert W. Helt, Stephen A. Guy and Richard F. Welguisz It is certified that error appears in the above-identified patent and that said Letters Patent is hereby corrected as shown below:

Title page,
Item [75], Inventors, add -- Richard F. Welguisz --.

Signed and Sealed this

Second Day of March, 2004

JON W. DUDAS
*Acting Director of the United States Patent and Trademark Office*